US008303333B2

(12) United States Patent
Lee

(10) Patent No.: US 8,303,333 B2
(45) Date of Patent: Nov. 6, 2012

(54) ELECTRONIC APPARATUS HAVING LIGHT-EMITTING POWER CONNECTOR

(75) Inventor: Yu-Lung Lee, Miaoli County (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 138 days.

(21) Appl. No.: 12/910,983

(22) Filed: Oct. 25, 2010

(65) Prior Publication Data

US 2012/0045925 A1 Feb. 23, 2012

(30) Foreign Application Priority Data

Aug. 23, 2010 (TW) ..... 99128090 A

(51) Int. Cl.
*H01R 3/00* (2006.01)

(52) U.S. Cl. ..... 439/488

(58) Field of Classification Search ..... 439/488, 439/490–491, 541.5, 502, 489
See application file for complete search history.

(56) References Cited

U.S. PATENT DOCUMENTS

| | | | | |
|---|---|---|---|---|
| 5,189,291 | A * | 2/1993 | Siemiatkowski | 235/462.45 |
| 6,319,051 | B1 * | 11/2001 | Chang et al. | 439/490 |
| 6,699,065 | B1 * | 3/2004 | Espenshade et al. | 439/490 |
| 7,004,595 | B1 * | 2/2006 | Stoddard | 362/95 |
| 7,393,237 | B2 * | 7/2008 | Kuo | 439/490 |
| 7,744,231 | B2 * | 6/2010 | Hutchinson et al. | 362/95 |

* cited by examiner

*Primary Examiner* — Jean F Duverne
(74) *Attorney, Agent, or Firm* — Rosenberg, Klein & Lee

(57) ABSTRACT

A light-emitting power connector is disclosed. The light-emitting power connector includes an insulating plug receiving portion, a shell, and a light emitting diode (LED). The insulating plug receiving portion includes a base from which a light penetrating part and a tongue section extend and a plurality of the conductive terminals. The shell is connected to the insulating plug receiving portion and located outside of the tongue section to define a socket between the shell and the tongue section. The LED is installed at a first predetermined position in the insulating plug receiving portion to ensure the shell and the light penetrating part are located within a viewing angle of the LED.

8 Claims, 5 Drawing Sheets

ELECTRONIC APPARATUS HAVING LIGHT-EMITTING POWER CONNECTOR

BACKGROUND OF THE INVENTION

1. Field of the Invention

The field of the invention is generally related to a connector, more particularly, to a light-emitting power connector and an electronic apparatus equipped with the light-emitting power connector.

2. Description of Related Art

Connectors have been used in virtually every electronic apparatus with a wide array of designs depending on the usage thereof. Conventional connectors are generally not equipped with any lighting means, rendering difficult locating the connectors in an environment without sufficient light.

SUMMARY OF THE INVENTION

In accordance with aspects of the present invention, a light-emitting power connector and an electron apparatus with the same are disclosed. The light comes out from the socket of the power connector for indicating the position of the power connector.

The current invention has following benefits. That the light comes out from the socket of the connector helps the locating of the connector in the environment without sufficient light. In addition, the connector with a power saving circuit installed in the electronic apparatus may turn on/off the light emitting function based on the connection between the connector and the plug. Furthermore, the connector with the power saving circuit may disable the light emitting function after determining the variance in the surrounding light intensity strength.

To achieve the above goal, the light-emitting connector according to the present invention includes an insulating plug receiving portion having a base from which a light penetrating part and a tongue section extend and a plurality of the conductive terminals, a shell connecting to the insulating plug receiving portion and located outside of the tongue section to define a socket between the shell and the tongue section, and at least a light emitting diode (LED), installed at a first predetermined position in the insulating plug receiving portion to ensure the shell and the light penetrating part are located within a viewing angle of the LED.

The aforementioned description, the following detail descriptions and figures are all used for further explaining manners, means, and effect taken in the current invention. Other objectives and advantages related to the current invention will be explained in the following descriptions and figures.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompany drawings, wherein like reference numerals refer to like parts throughout the various views unless otherwise specified.

DETAILED DESCRIPTION OF THE PREFERRED EMBODIMENTS

Figure 1:
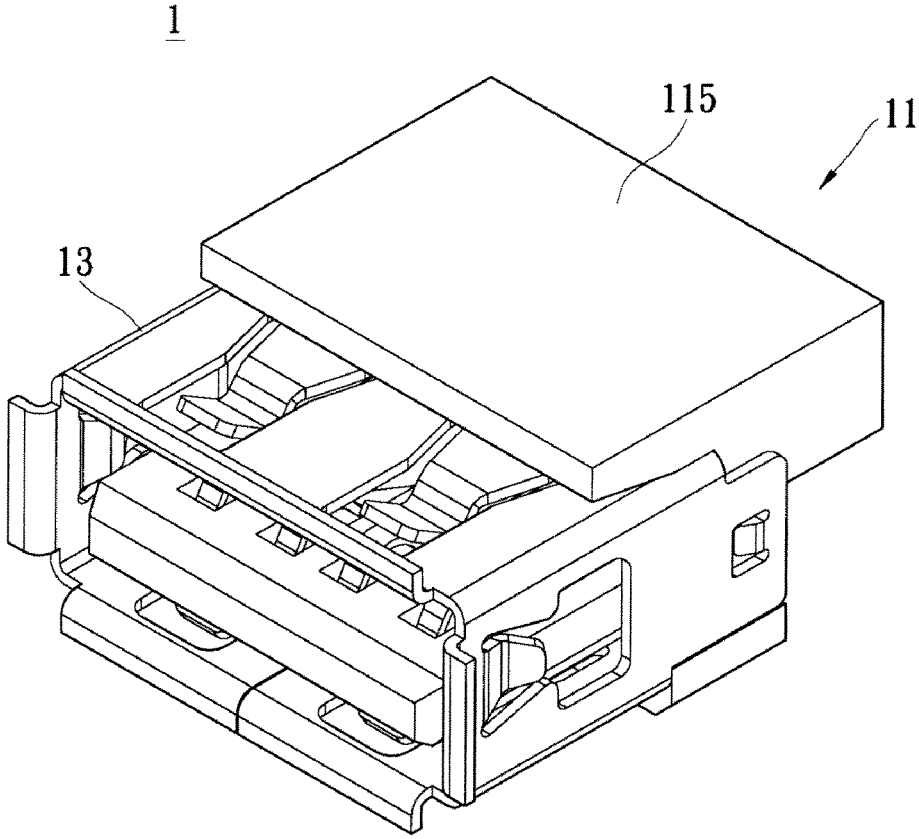
FIG. 1 illustrates a schematic diagram of a light-emitting power connector according to one embodiment of the present invention.
Figure 2:
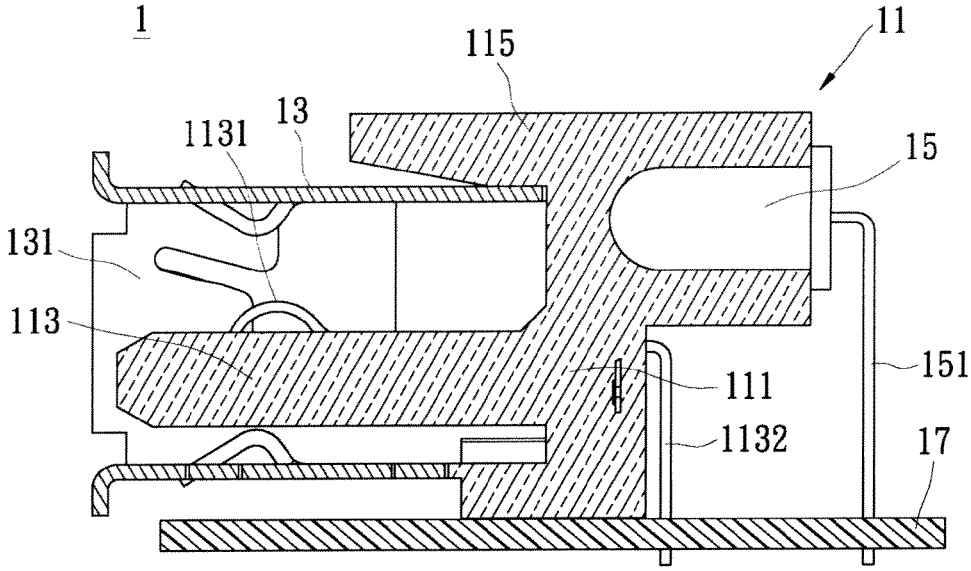
FIG. 2 illustrates a sectional view of the light-emitting power connector shown in FIG. 1.

Please refer to FIG. 1, FIG. 1 illustrates a schematic diagram of a light-emitting power connector according to an embodiment of the present invention. Please refer to FIG. 2 in which a sectional view of the light-emitting power connector shown in FIG. 1 is illustrated.

A light-emitting power connector 1 includes an insulating plug receiving portion 11 and a shell 13. The insulating plug receiving portion 11 has a light emitting diode (LED) 15 inside. In one implementation, there could be more than one LED 15 inside of the insulating plug receiving portion 11. And the LEDs 15 may be emitting different colors.

The insulating plug receiving portion 11 includes a base 111, a light penetrating part 115, and a tongue section 113. The insulating plug receiving portion 11 could be made of a transparent material or a semitransparent material. The light penetrating part 115 and the tongue section 113 extend from one side of the base 111 so that the light penetrating part 115 is located outside of the shell 13. The tongue section 113, meanwhile, is inside of the shell 13 so that the shell 13 is located outside of the tongue section 113. And a socket 131 is defined between the shell 13 and the tongue section 113. Additionally, the insulating plug receiving portion 11 has a plurality of conductive terminals 1131.

The LED 15 inlays into the base 111 at a first predetermined position which could allow for the light emitted from the LED 15 to be outputted to the light penetrating part 115 and the shell 13. To serve that purpose, the light penetrating part 115 and the shell 13 may be located within a viewing angle of the LED 15. However, the position of the LED 15 does not have any limitation and could be adjusted according to the practical requirements. Therefore, the light-emitting power connector 1 may be capable of emitting sufficient amount of light.

Moreover, the light-emitting power connector 1 could be installed on a substrate 17. For example, the light-emitting power connector 1 could be welded on the substrate 17 through the pins 1132 extending from the conductive terminals 1131 and pin 151 extending from the LED 15.

Figure 3:
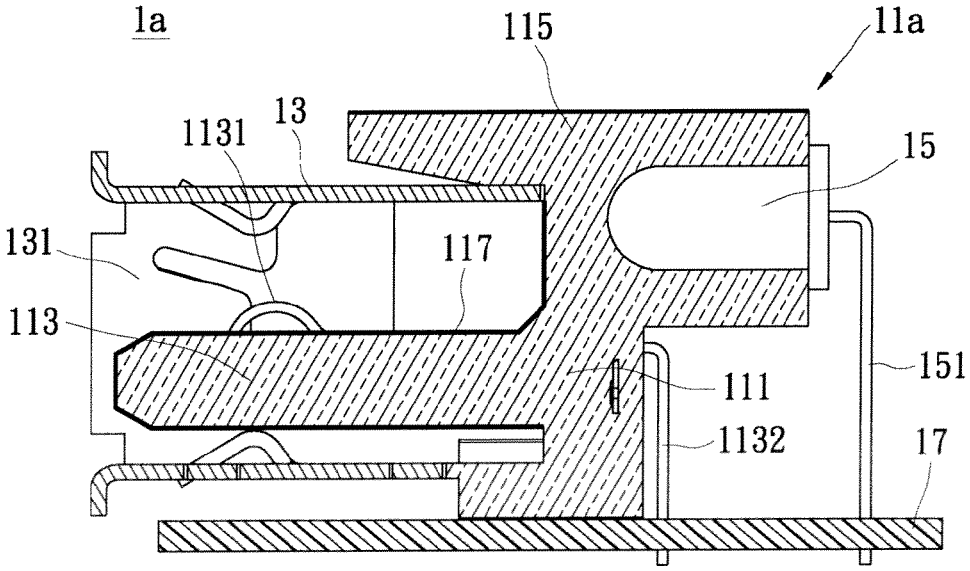
FIG. 3 illustrates a sectional view of a light-emitting power connector according to another embodiment of the present invention.

Please refer to the FIG. 3 in which a sectional view of a light-emitting power connector 1*a* according to the second embodiment of the present invention. The light-emitting power connector 1*a* when compared with the power connector 1 in FIG. 2 further includes a reflective layer 117 at a second predetermined position so that the light of the LED 15 may be reflected at the second predetermined position before being outputted to the light penetrating part 115 and/or shell 13. The reflective layer 117 may be configured to enhance the light emitting effect of the power connector 1*a*. In one implementation, more than one reflective layer 117 may be placed within the insulating plug receiving portion.

The aforementioned embodiments all include the LED 15 inside of the insulating plug receiving portion 11. In other embodiments, the LED 15 may be placed outside of the insulating plug receiving portion 11.

Figure 4:
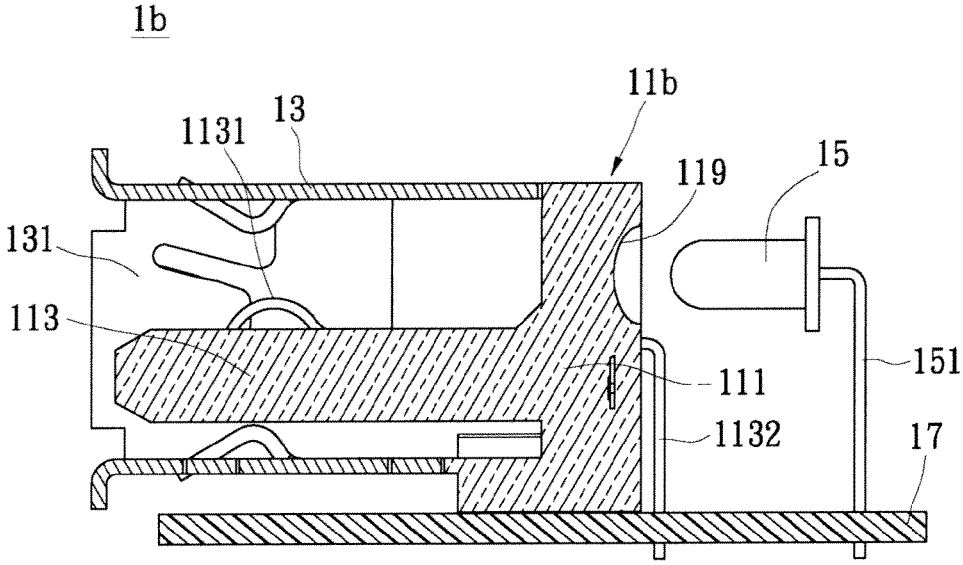
FIG. 4 illustrates a sectional view of a light-emitting power connector according to another embodiment of the present invention.

Please refer to the FIG. 4 in which a sectional view of a light-emitting power connector 1*b* according to another embodiment of the present invention is disclosed. The light-emitting power connector 1*b* includes the shell 13, the insulating plug receiving portion 11*b*, the substrate 17 and the LED 15.

The shell 13 is connected to the insulating plug receiving portion 11*b* and the insulating plug receiving portion 11*b* includes the base 111 and the tongue section 113. The insulating plug receiving portion 11*b* may be made of the transparent material or the semitransparent material. The tongue section 113 extends from one side of the base 111 and is located inside of the shell 13. Accordingly, a socket 131 may be defined between the shell 13 and the tongue section 113. The tongue section 113 has a plurality of conductive terminals 1131. The pins 1132 at ends of these conductive terminals 1131 extend from the base 111.

One side of the base 111 forms a light guiding section 119. The light guiding section 119 is capable of guiding the light from a light source outside of the insulating plug receiving portion 11*b* through the insulating plug receiving portion 11*b* to the socket 131. In one implementation, the light conducting section 119 is an optics component which could be a condenser lens or a divergent lens. Thus, while the light guiding section 119 is the condenser lens, the light from the light source may be condensed so that an outputted light from the socket 131 may be of a higher intensity. When the light guiding section 119 is the divergent lens, the light from the light source may be diverged and the corresponding outputted light from the socket 131 may be covering a larger range.

Pin 151 and pins 1132 of the conductive terminals and the LED 15 are separately welded on the substrate 17. The LED 15 is located outside of the insulating plug receiving portion 11*b* and adjacent to the light guiding section 119. The light from the LED 15 may be outputted through the light guiding section 119 inside of the insulating plug receiving portion 11*b* before being outputted to the socket 131. In addition, the LED 15 is associated with a certain viewing angle, which may cover both of the light guiding section 119 and a certain area surrounding the insulation plug receiving portion 11*b*. Consequently, the light-emitting power connector 1*b* may be implemented so long as the tongue section 113 of the insulation plug receiving portion 11*b* is within the viewing angle of the LED 15 regardless of the location of the LED 15. When the tongue section 113 is within the viewing angle of the LED 15, the light emitted from the LED 15 may penetrate a gap of the shell 13 and may be projected into the tongue section 113 before being outputted from the socket 131.

Figure 5:
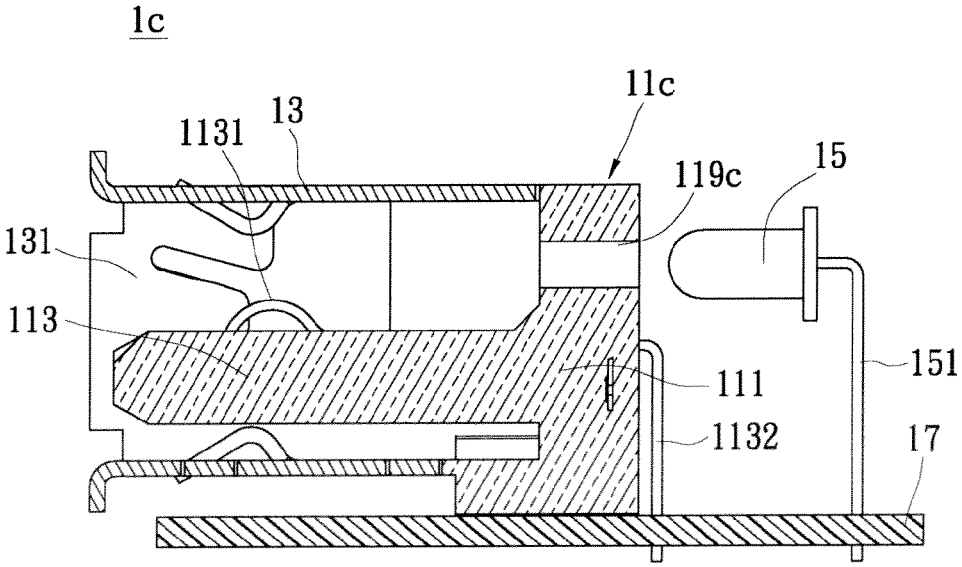
FIG. 5 illustrates a sectional view of a light-emitting power connector according to another embodiment of the present invention.

Please refer to FIG. 5 in which a sectional view of a light-emitting power connector 1*c* according to one embodiment of the present invention is illustrated. The power connector 1*c* when compared with its counterpart in the FIG. 4 replaces the light guiding section 119 with a light transmitting hole 119*c*. The light transmitting hole 119*c* punches through the base 111 of the insulating plug receiving portion 11*c* for communicating with the socket 131 of the shell 13. Therefore, through the configuration of this embodiment, the light of the LED 15 may be outputted through the light transmitting hole 119*c* to the socket 131.

The embodiments shown in FIG. 4 and FIG. 5 may also include reflective layers such as the reflective layer 117 shown in FIG. 3 at predetermined positions.

Figure 6:
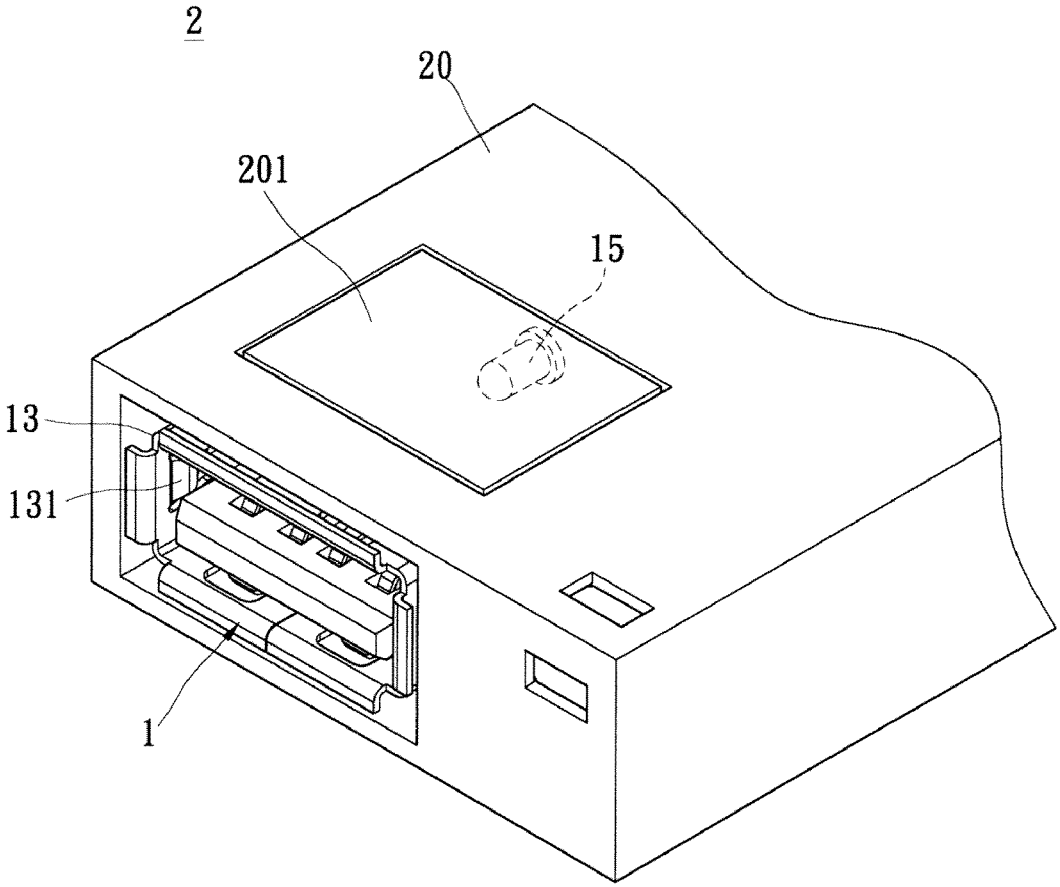
FIG. 6 illustrates a schematic diagram illustrating an electronic apparatus with the light-emitting power connector according to one embodiment of the present invention.

Please refer to FIG. 6 in which a schematic diagram illustrating an electronic apparatus 2 having the light-emitting power connector according to one embodiment of the present invention is disclosed. The electronic apparatus 2 has the light-emitting power connector 1 in the main body 20. In one implementation, the light-emitting power connector 1 is based upon the same shown in FIG. 2.

The main body 20 could be a charger, an adapter, an outlet or other electronic apparatus powered by the light-emitting power connector 1. A display window 201 is located on a surface of the main body 20 and above the light-emitting power connector 1 so that the light of the LED 15 may be outputted through the display window 201 with the light of the LED 15 being outputted from the inside of the main body to the socket 131 of the shell 13.

Therefore, the electronic apparatus 2 with the light-emitting power connector 1 may be located without much difficulty in the environment without sufficient light by the light emitted from the display window 201 of the main body 20 or the socket 131 of the shell 13.

In addition, it is worth noting that the light-emitting power connector 1 may be installed at more than one position in the main body 20 and the configuration shown in FIG. 6 is only an example.

Figure 7:
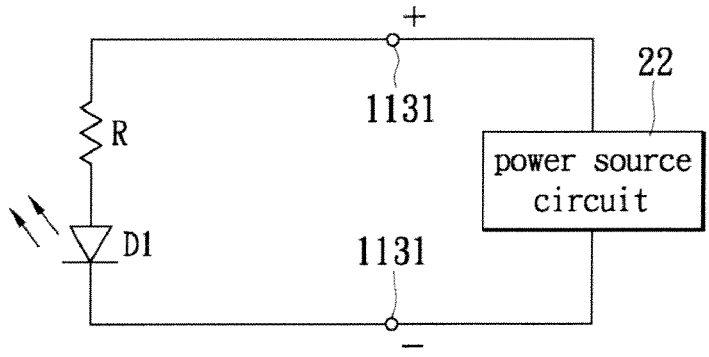
FIG. 7 illustrates a simplified circuit block diagram of the electronic apparatus shown in the FIG. 6.

Please refer to the FIG. 7 in which a simplified circuit block diagram of the electronic apparatus 20 shown in the FIG. 6 is demonstrated. The electronic apparatus 20 has a power supply circuit 22. The power supply circuit 22 could directly output power to the conductive terminal 1131 and the LED D1 of the light-emitting power connector 1. The aforementioned power supply circuit 22 could be a recharge circuit or a power converting circuit. Besides, the LED D1 may be connected to a resistor, which is configured to limit the current flowing through the LED D1, in series to ensure the LED D1 may run normally. Thus, while the power supply circuit 22 is activated the LED D1 may operate as well.

The circuit configuration shown in FIG. 6, however, consume power while the electronic apparatus 2 is activated causing the LED D1 to operate continually. Thus, FIG. 8 illustrates another simplified circuit block diagram of an electronic apparatus with the light-emitting power connector and a power saving circuit according to one embodiment of the present invention.

The power saving circuit may be located between the power supply circuit 222 and the LED D1. In one implementation, the power saving circuit is a switch 24. The switch 24 may be placed at a predetermined position to abut (or in contact with) a plug (not shown) while the plug is received into the shell 13.

While the electronic apparatus 2 is turned on, the power supply circuit 22 could normally output power to the conductive terminal 1131. If the shell 13 of the light-emitting power connector 1 has not received the plug, the switch 24 may continually causes the LED D1 to be powered by the power supply circuit 22. On the contrary, while the shell 13 of the light-emitting power connector 1 receives the plug, the switch 24 may switch off a loop between the LED D1 and the power supply circuit 22 as the result of abutting the plug so that the LED D1 may stop its operation.

Figure 8:
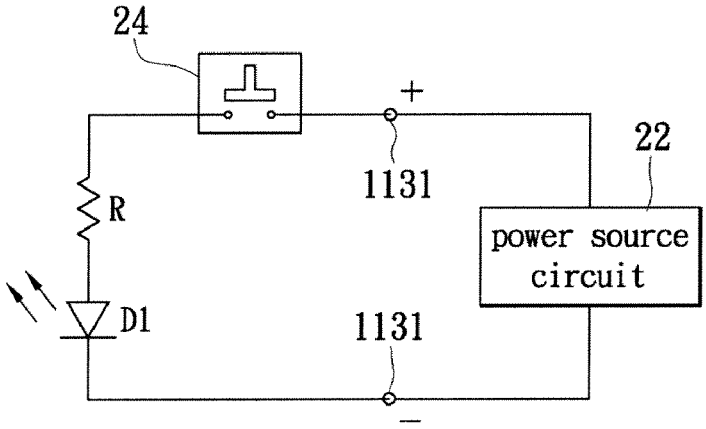
FIG. 8 illustrates a simplified circuit block diagram of an electronic apparatus with the light-emitting power connector and a power saving circuit according to one embodiment of the present invention.

Therefore, the circuit shown in the FIG. 8 may outperform its counterpart in FIG. 6 in power consumption. While the light-emitting power connector 1 has not received the plug, the power connector 1 may emit the light from the LED for indicating the position thereof. While the light-emitting power connector 1 has received the plug, the power connector 1 may stop emitting the light. Under that arrangement, more power may be saved.

Figure 9:
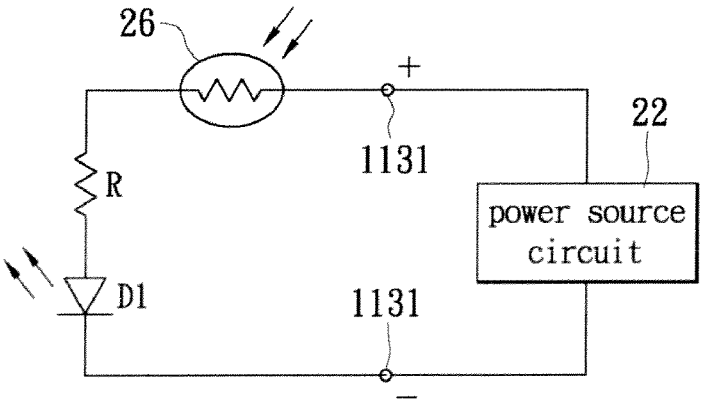
FIG. 9 illustrates a simplified circuit block diagram of an electronic apparatus with the light-emitting power connector and the power saving circuit according to one embodiment of the present invention.

Please refer to the FIG. 9 in which a circuit block diagram of another electronic apparatus with the light-emitting power connector and the power saving circuit according to one embodiment of the present invention is disclosed. The power saving circuit may be in the form of a photo sensor 26. The photo sensor 26 couples to the power supply circuitry between the conductive terminal 1131 and the LED D1. The photo sensor 26 may be located at another predetermined position of the main body 20 to detect the surrounding variance in light intensity.

Thus, while the electronic apparatus 2 is turned on, the power supply circuit 22 outputs the power to the conductive terminal 1131 and the photo sensor 26 may detect the surrounding variance in the light intensity of the main body 20 before adjusting an impedance value thereof. In one implementation, the photo sensor 26 may set the impedance to an infinitive value when the light intensity surrounding the main body 20 reaches a predetermined level in order to stop the LED D1 from being powered. Consequently, the power consumption of the electronic apparatus may be reduced. On the other hand, while the surrounding light intensity of the main body 20 is fails to reach the predetermined level the photo sensor 26 may set its impedance to a small value, causing the LED D1 to be continually powered and operating.

Some modifications of these examples, as well as other possibilities will, on reading or having read this description, or having comprehended these examples, will occur to those skilled in the art. Such modifications and variations are comprehended within this invention as described here and claimed below. The description above illustrates only a relative few specific embodiments and examples of the invention. The invention, indeed, does include various modifications and variations made to the configurations and operations described herein, which still fall within the scope of the invention as defined in the following claims.

What is claimed is:

1. An electronic apparatus having a light-emitting power connector, comprising:

a main body having a power supply circuit;

a power connector located in the main body having an insulating plug receiving portion and a light emitting diode (LED), wherein the insulating plug receiving portion includes a plurality of conductive terminals; and a power saving circuit located between the power supply circuit and the LED, wherein the power saving circuit controls the electric power provided into the LED, when the shell receives a plug the power saving circuit switches off a loop between the LED and the power supply circuit;

wherein a tongue section of the insulating plug receiving portion is within a viewing angle of the LED and the conductive terminals and the LED are powered by the power supply circuit.

2. The electronic apparatus of claim 1, wherein the main body includes a display window located adjacent to one end of the power supply allowing for the light of the LED to be displayed.

3. The electronic apparatus of claim 1, wherein the main body is a recharger, an adapter or an outlet.

4. The electronic apparatus of claim 1, wherein the power saving circuit is a switch for switching off a loop the power supply circuit when the shell receives a plug and the switch is in contact with the plug.

5. The electronic apparatus of claim 1, wherein the power saving circuit comprises a photo sensor for sensing a variation in a light intensity surrounding the main body before controlling a value of an electrical current passing through the LED.

6. The electronic apparatus of claim 1, wherein the LED is located inside of the insulating plug receiving portion, and the insulation plug receiving portion includes a light penetrating part allowing for the light of the LED to be outputted outside of the insulating plug receiving portion.

7. The electronic apparatus of claim 1, wherein the LED is located outside of the insulating plug receiving portion and adjacent to a light guiding section that guides the light of the LED inside of the insulating plug receiving portion and to be outputted from the socket.

8. The electronic apparatus of claim 1, wherein the power supply circuit is a recharging circuit or a power source converting circuit.

* * * * *